US009282829B2

(12) United States Patent
Caruso et al.

(10) Patent No.: US 9,282,829 B2
(45) Date of Patent: Mar. 15, 2016

(54) BED-MOUNTABLE EXERCISE APPARATUS

(71) Applicant: DreamFit LLC, Staten Island, NY (US)

(72) Inventors: Grace Caruso, Staten Island, NY (US); Andre Lutfy, Staten Island, NY (US)

(73) Assignee: BedGym LLC, Staten Island, NY (US)

( * ) Notice: Subject to any disclaimer, the term of this patent is extended or adjusted under 35 U.S.C. 154(b) by 526 days.

(21) Appl. No.: 13/627,649

(22) Filed: Sep. 26, 2012

(65) Prior Publication Data

US 2013/0074270 A1 Mar. 28, 2013

Related U.S. Application Data

(60) Provisional application No. 61/539,735, filed on Sep. 27, 2011, provisional application No. 61/581,206, filed on Dec. 29, 2011.

(51) Int. Cl.

| | |
|---|---|
| ***A47C 31/08*** | (2006.01) |
| ***A63B 21/04*** | (2006.01) |
| ***A63B 21/055*** | (2006.01) |
| ***A63B 21/16*** | (2006.01) |
| ***A47C 21/00*** | (2006.01) |

(52) U.S. Cl.

CPC ..... *A47C 31/08* (2013.01); *A47C 21/00* (2013.01); *A63B 21/0442* (2013.01); *A63B 21/0552* (2013.01); *A63B 21/0557* (2013.01); *A63B 21/16* (2013.01); *A63B 21/1672* (2015.10); *A63B 21/4013* (2015.10); *A63B 21/4021* (2015.10); *A63B 21/4035* (2015.10); *A63B 21/4043* (2015.10); *A63B 2210/04* (2013.01)

(58) Field of Classification Search

CPC ..... A47C 21/02; A47C 31/08; A47C 21/00; A47G 9/04; A63B 21/028; A63B 21/04; A63B 21/0407; A63B 21/0414; A63B 21/0442; A63B 21/055; A63B 21/0552; A63B 21/0557; A63B 21/1672; A63B 21/1609; A63B 21/16; A63B 21/4043; A63B 21/4035; A63B 21/4013; A63B 21/4021; A63B 2210/04

USPC ..... 5/496, 498, 499, 658; 482/904, 121, 482/123, 126, 130

See application file for complete search history.

(56) References Cited

U.S. PATENT DOCUMENTS

| | | | | |
|---|---|---|---|---|
| 679,656 | A * | 7/1901 | Whiting | 5/658 |
| 2,132,556 | A * | 10/1938 | Blackshaw | 297/484 |
| 2,188,576 | A * | 1/1940 | Mulloy | 5/498 |
| 4,593,902 | A | 6/1986 | Michaelsen | |
| 4,609,188 | A * | 9/1986 | Lind | 482/140 |

(Continued)

OTHER PUBLICATIONS

International Search Report and Written Opinion from PCT/US2012/57306, Dec. 24, 2012, 10 pgs.

*Primary Examiner* — Nicholas Polito
(74) *Attorney, Agent, or Firm* — Nixon Peabody LLP

(57) ABSTRACT

Various embodiments relate to an exercise assembly and an exercise bed assembly. The exercise assembly includes a band configured to be fitted around the circumference of a bed mattress or support frame and includes areas to which exercise bands can be attached. One or more exercise bands can be attached so that a user can perform various bodyweight exercises. The exercise bands can be reset in various combinations in order to enable a user to complete different exercises. In some embodiments, the exercise assembly can also include reinforcements that are connected at multiple points of the band. In some instances, the reinforcements cover a side of the bed.

16 Claims, 7 Drawing Sheets

(56) References Cited

U.S. PATENT DOCUMENTS

| | | | | | |
|---|---|---|---|---|---|
| 4,611,804 | A | * | 9/1986 | Addair | 482/131 |
| 4,653,131 | A | | 3/1987 | Diehl | |
| 4,742,821 | A | | 5/1988 | Wootan | |
| 5,160,306 | A | * | 11/1992 | Lui | 482/140 |
| 5,701,620 | A | * | 12/1997 | Montross | 5/658 |
| 5,743,838 | A | * | 4/1998 | Willis | 482/124 |
| 5,803,881 | A | * | 9/1998 | Miller | 482/124 |
| 5,820,519 | A | | 10/1998 | Slenker | |
| 6,085,370 | A | * | 7/2000 | Lobascio | 5/510 |
| 6,117,056 | A | * | 9/2000 | Cataldi et al. | 482/121 |
| 6,500,104 | B1 | * | 12/2002 | Rich | 482/123 |
| D481,579 | S | | 11/2003 | Colbert et al. | |
| 6,874,180 | B2 | * | 4/2005 | Liao | 5/486 |
| 7,168,113 | B1 | * | 1/2007 | Olsen | 5/493 |
| 7,883,453 | B1 | | 2/2011 | Cooper | |
| 8,162,809 | B1 | * | 4/2012 | Eastwood | 482/123 |
| 2003/0224912 | A1 | * | 12/2003 | Zagone | 482/80 |
| 2006/0046906 | A1 | * | 3/2006 | Simkhaev | 482/91 |
| 2010/0223726 | A1 | * | 9/2010 | Maloney | 5/500 |

* cited by examiner

BED-MOUNTABLE EXERCISE APPARATUS

CROSS-REFERENCE TO RELATED APPLICATIONS

This application claims the benefit of and priority to U.S. Provisional Application No. 61/539,735, filed Sep. 27, 2011, and U.S. Provisional Application No. 61/581,206, filed Dec. 29, 2011, each of which are owned by the assignee of interest and in their entireties incorporated herein.

TECHNICAL FIELD

Various exemplary embodiments disclosed herein relate generally to exercise equipment. More specifically, the subject matter relates to portable exercise equipment to be used in conjunction with a bed.

BACKGROUND

Home exercise is a regular activity practiced by many individuals using various exercise equipment to enable stretching and cardiovascular, weight, and strength training, and can be used for health and rehabilitation. While home exercise has enabled individuals to exercise more consistently and with greater frequency, a continuing restraint to many individuals has been the space requirements associated with home exercise equipment. Individuals who occupy small or crowded spaces, such as hospitals, apartments, retirement homes, and nursing homes, may not have proper room to conduct exercises correctly without risking injury.

In view of the foregoing, it would be desirable to have exercise equipment that does not require significant additional space inside a home. Specifically, it would be highly desirable to have exercise equipment that used existing elements found in homes.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in the later sections.

Various embodiments may relate to an exercise equipment assembly to be used with a bed assembly. The exercise equipment assembly allows the attachment of one or more exercise bands to enable users to perform various bodyweight exercises both on and around the bed assembly. Various embodiments relate to an exercise bed assembly comprising a bed comprising a mattress, with or without a support frame, and an exercise assembly fitted around the circumference of the mattress, around the circumference of the support frame, or around both the mattress and the support frame. Various embodiments include an exercise assembly comprising a horizontal band having a length at least equal to the circumference of the bed and/or the support frame. Some embodiments include a reinforcement piece connected to the horizontal band, wherein the reinforcement piece extends from a first connection point on the horizontal band under the mattress to a second connection point opposite the first connection point.

In other examples, any of the aspects above can include one or more of the following features. In some embodiments, the exercise bed assembly can further include at least one exercise loop connected to the horizontal band. In some embodiments, the exercise bed assembly includes at least one hole in the horizontal band. This hole can be supported with a grommet. In some embodiments, the reinforcement piece of the exercise bed assembly comprises at least one reinforcement strap. In some embodiments, the horizontal band of the exercise bed assembly further comprises a fastening means, such as a buckle and catch, or a hook-and-loop fastener (e.g., a Velcro® brand hook and loop fasteners), at each end of the horizontal band.

It should be apparent that, in this manner, various exemplary embodiments enable the use of existing elements of a home to form an exercise assembly. Particularly, by enabling the use of a bed assembly, a user can construct an exercise assembly without using a significant amount of additional space inside a room.

BRIEF DESCRIPTION OF THE DRAWINGS

In order to better understand various exemplary embodiments, reference is made to accompanying drawings, wherein.

DETAILED DESCRIPTION

Figure 1A:
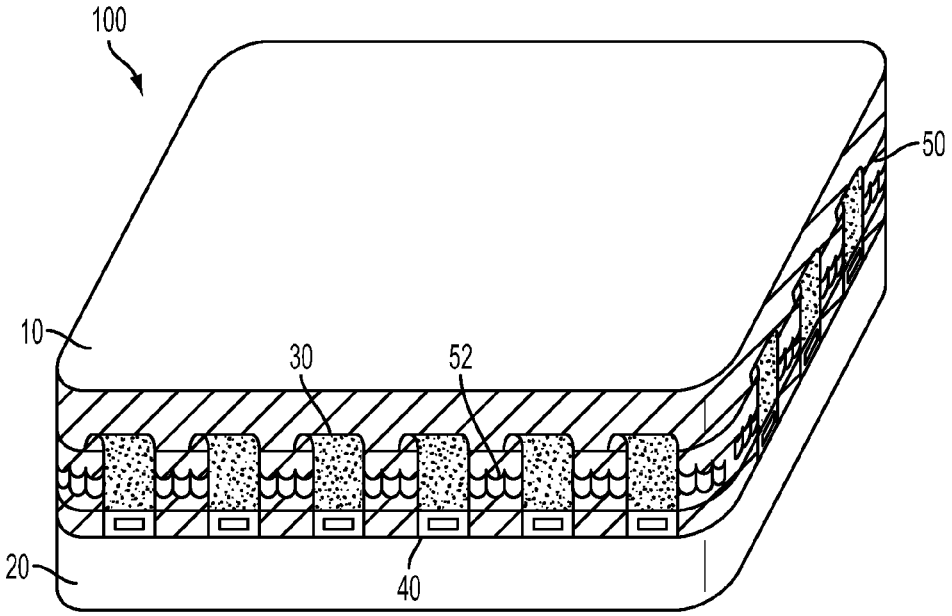
FIG. 1A illustrates an exemplary bed assembly.

FIG. 1A shows an exemplary bed assembly 100, including a mattress 10, a support frame 20, reinforcement straps 30, buckles 40, and horizontal band 50 that includes exercise loops 52. In exemplary embodiments, the exercise assembly includes the horizontal band 50 along with a series of reinforcement straps 30 and buckles 40. In some embodiments, exercise bands (not shown) can hook onto or loop around the exercise loops 52.

The mattress 10 can be, for example, a mattress of a standard size, such as a twin, twin extra long, full, queen, king, and California king mattress sizes. In some embodiments, the bed assembly 100 can include the mattress 10 without the support frame 20 (e.g., when the mattress is supported by the floor). The support frame 20 can be, for example, a frame with support beams or slats, or a spring box (i.e., "box spring") that supports the mattress. In some embodiments, the exercise assembly can be placed between the mattress 10 and the support frame 20, as illustrated in the bed assembly 100. In other embodiments, the exercise assembly can be placed between the support frame 20 and the floor (not shown). In the embodiment of FIG. 1A, as well as all subsequent embodiments described herein, and other embodiments that one of skill in the art may contemplate based on the embodiments disclosed herein, horizontal band 50 of the exercise assembly can wrap around the circumference of either the mattress 10, or the support frame 20, or both the mattress 10 and the support frame 20 (e.g. the horizontal band 50 can be wide enough to wrap both the mattress 10 and support frame 20 or the horizontal band 50 can be in the form of a dual horizontal band system for purposes of enabling exercise loops to be provided at different heights from the floor).

The exercise assembly can include the horizontal band 50, reinforcement straps 30, and buckles 40. In the embodiment of FIG. 1A, as well as all subsequent embodiments described herein, and other embodiments that one of skill in the art may contemplate based on the embodiments disclosed herein, the exercise assembly can include the horizontal band 50 with or without any reinforcement straps 30 or buckles 40. The horizontal band 50 can be a support band made of a strong material, such as elastic, weaved nylon, or such other applicable materials that would be known to a person of skill in the art. The material of the horizontal band 50 can wrap around the circumference of the mattress 10 and/or support frame 20. In some embodiments, the horizontal band 50 can be of the same length as the circumference of the mattress 10 and/or support frame 20 (e.g., the circumference of a twin, twin extra long, full, queen, king, or California king-sized mattress or support frame). When the horizontal band 50 has the same length as the circumference of the mattress 10 and/ or support frame 20, the horizontal band 50 can be made of a material like elastic to enable a user to place the horizontal band 50 around the circumference of the mattress 10 and/or support frame 20. The length of the horizontal band 50 can be sized to be equal to a standard mattress size (and/or corresponding support frame), such as twin, twin extra long, full, queen, king, and California king. In such instances, the horizontal band 50 fits snuggly against the mattress 10 and/ or support frame 20 with sufficient force to remain in place around the mattress 10 and/or support frame 20 when the user exerts force on the horizontal band 50 via exercise bands or other attached exercise equipment.

In some embodiments, the length of the horizontal band 50 can be longer than the circumference of the mattress 10 and/or support frame 20 when wrapped around said mattress 10 and/or support frame 20. In such instances, a single horizontal band 50 can be used for multiple standard bed sizes (and their corresponding support frames), including, twin, twin extra long, full, queen, king, and California king. In these embodiments, the horizontal band 50 can also have fastening means at its ends to ensure that the horizontal band 50 remains in place around the mattress 10 and/or support frame 20 when the user exerts force on the horizontal band 50 via exercise bands or other attached exercise equipment. For example, the horizontal band 50 can include a buckle and catch (not shown) through which the user tightens the horizontal band 50 once placed around the width of the mattress 10 and/or support frame 20. The horizontal band 50 can also include other fastening means, such as a clasp, buckle trim, hook-and-loop fastener, or similar means familiar to those of skill in the art to ensure the horizontal band 50 remains around the circumference of the mattress 10 or the support frame 20.

The horizontal band 50 can also include exercise loops 52. In some embodiments, the exercise loops 52 continuously line the length of the horizontal band 50. In some embodiments, the exercise loops 52 are spaced apart in groups to allow the reinforcement straps 30 to loop around the horizontal band 50 without covering the exercise loops 52. In some embodiments, the exercise loops 52 can have different widths. In such instances, the user can, for example, use exercise bands of different thicknesses or use connectors of varying thickness by attaching the exercise band or connector to an exercise loop 52 of the proper width. In some embodiments, the exercise band can be looped around a section of the entire horizontal band 50. In some embodiments, the exercise loops 52 are made of the same material as the horizontal band 50, such as elastic or nylon. In some embodiments, the exercise loops 52 are sewn onto the horizontal band 50. In some embodiments, the horizontal band 50 can include other attachment points for the exercise band 60. For example, the horizontal band can include other connectors (not shown), including, for example, O-rings, D-rings, carabiners, or other connectors known to a person of skill in the art. For example, in some embodiments, the horizontal band 50 can include connectors made of the same material as the connectors 63, 65 used in the exercise band.

Figure 1B:
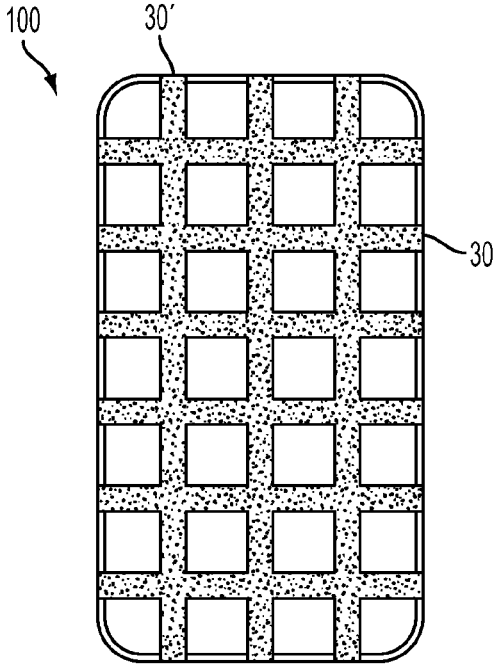
FIG. 1B illustrates another view of an exemplary bed assembly.

FIG. 1B illustrates another view of the exemplary bed assembly. FIG. 1B illustrates the underside of the mattress 10, including a series of parallel reinforcement straps 30 that extend across the width of the mattress 10 and a series of parallel reinforcement straps 30' that extend across the length of the mattress 10. The reinforcement straps 30, 30' can be made of the same material as the horizontal band 50, including materials like elastic and nylon. In some embodiments, the reinforcement straps can be made of a stronger, less flexible material than the horizontal band 50, such as nylon webbing, ballistic nylon, and similar materials used for strength. The reinforcement straps 30, 30' can be attached to the horizontal band 50 at two different locations. For example, a widthwise reinforcement strap 30 can be attached at a first location on the horizontal band 50, extend below the mattress 10, and be attached at a second location on the horizontal band 50 at the opposite side of the mattress 10. Likewise, a lengthwise reinforcement strap 30' can be attached at a first location on horizontal band 50, extend below the mattress 10, and be attached at a second location on the horizontal band 50 at the opposite side of the mattress 10. In some embodiments, the reinforcement straps 30, 30' extend between the mattress 10 and the support frame 20. In other embodiments, the reinforcement straps 30, 30' extend below the support frame 20.

In some embodiments, the lattice created by the parallel reinforcement straps 30, 30' can be created by the user when weaving the individual reinforcement straps 30, 30' through each other. In some embodiments, the reinforcement straps 30, 30' can be sewn into a pattern, such as the lattice illustrated in FIG. 1B. In other embodiments, the lattice can be created from fewer pieces of material. For example, in some embodiments, the lattice can be created from a single piece of material. Other methods of creating the lattice and similar patterns are known to a person of skill in the art.

In some embodiments, the reinforcement straps 30, 30' can also have buckles 40, as illustrated in FIG. 1A. The user may tighten the reinforcement straps 30, 30' through the use of the buckles 40 in order to secure the horizontal band 50 against the mattress 10. In other embodiments, the reinforcement straps 30, 30' can also have other types of tightening means. This can include, for example, other types of buckles or hook-and-loop fasteners.

In some embodiments, the user can first place the reinforcement straps 30, 30' under the mattress 10, then weave the horizontal band 50 through the ends of the reinforcement straps 30, 30' created by the buckles 40. The user can then tighten the horizontal band 50 using the tightening means at the end of the horizontal band 50. Once the horizontal band is tightened, the user can then tighten the reinforcement straps 30, 30' using the buckles 40. In other embodiments, the user can first place the horizontal band 50 around the mattress 10 before looping the ends of the reinforcement straps 30, 30' around locations of the horizontal band 50.

Figure 2A:
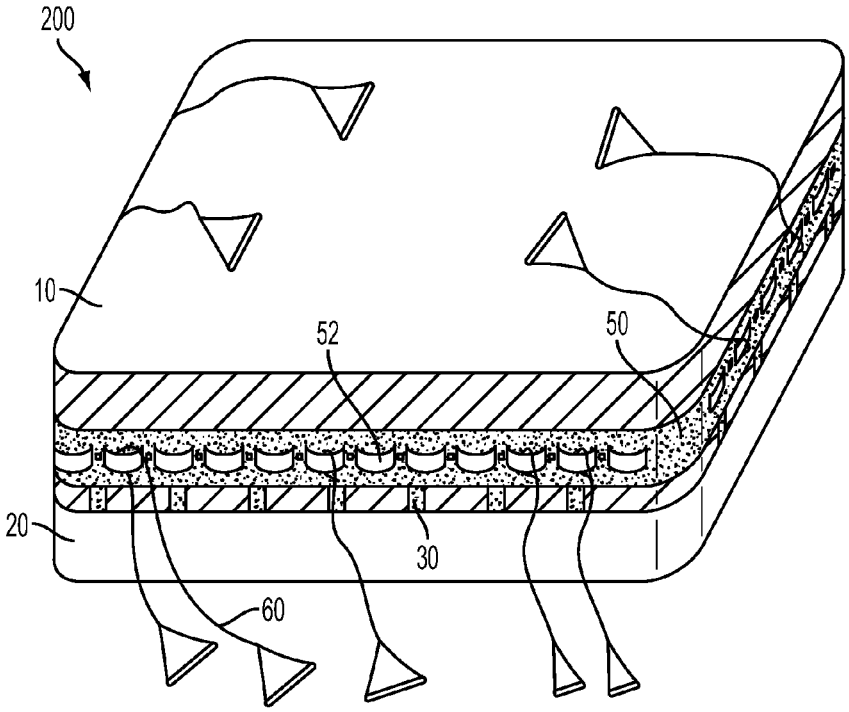
FIG. 2A illustrates another exemplary bed assembly.

FIG. 2A illustrates another exemplary bed assembly 200, including a mattress 10, a support frame 20, reinforcement straps 30, horizontal band 50, exercise loops 52, and exercise bands 60. The bed assembly 200 is similar to the bed assembly 100 of FIG. 1A. In addition, the bed assembly 200 further has a series of exercise bands 60. The exercise bands 60 can either be single-ended exercise bands that are attached to an exercise loop 52 on the horizontal band 50 through a connector, or can be double-ended exercise bands with handles on each end, with the exercise band weaved through an exercise loop 52. In the illustrative embodiment, for example, the reinforcement piece includes reinforcement straps 30 that are affixed directly to the horizontal band 50 (e.g., by sewing) to make its connection. In other embodiments, the reinforcement straps can be formed as a unitary piece, or bonded through other methods (e.g., rivets, adhesive, weaving, etc.) known to a person of skill in the art. This can include, for example, other types of buckles or hook-and-loop fasteners.

Figure 2B:
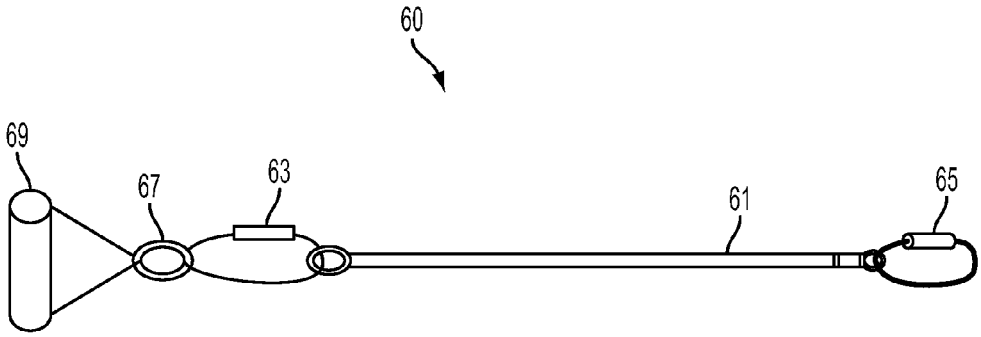
FIG. 2B illustrates an exemplary single-ended exercise band.

FIG. 2B illustrates an exemplary single-ended exercise band 60, including stretching band 61, connectors 63, 65, handle attachment 67, and handle 69. The stretching band 61 can be made of a material like elastic, rubber, or similar stretching material to provide resistance to a user when moved during an exercise. In some embodiments, the exercise band 60 can be a double ended exercise band. In such instances, the stretching band 61 can have no attachments on its ends, or handles 69 with handle attachments 67 attached at each end. In other embodiments, the exercise band 60 can be a single-ended exercise band. In such instances, the exercise band 60 can have a connector 65 at one end to connect the stretching band to the exercise loop 52. The exercise band can also have a connector 63 to connect the stretching band 61 to a handle 69 via a handle attachment 67. In some embodiments, the connectors 63, 65 and the handle attachment 67 are made of the same material, such as a strong metal like steel. The connectors 63, 65 and handle attachment 67 can be loops with openings like carabiners (with either a spring or a screwed gate), where the loop is closed during exercise and open to allow attachment or detachment.

Figure 3:
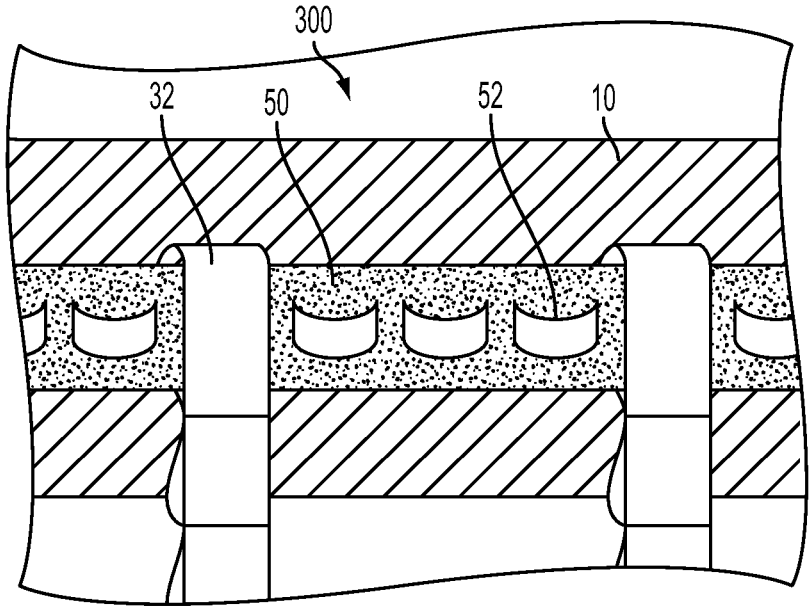
FIG. 3 illustrates a side view of an exemplary bed assembly.

FIG. 3 illustrates a side view of an exemplary bed assembly 300 including horizontal band 50 with reinforcement straps 32. In the bed assembly 300, the mattress 10 has the horizontal band 50 including exercise loops 52 fitted around its circumference, while the reinforcement straps 32 extend below the mattress 10. In the illustrative embodiment, the reinforcement straps 32 include one or more adjustment loops through which the horizontal band 50 is weaved. The adjustment loops on the reinforcement straps 32 allow the user to specify the vertical placement of the horizontal strap 50 around the mattress, and adjust the tension in the reinforcement straps 32 to fit the mattress, as the user weaves the horizontal strap 50 through the loops of the series of reinforcement straps 32. The adjustment loops of the reinforcement straps 32 along with horizontal band 50 with tightening means can be used as an exercise assembly that fits a wide range of bed sizes and bed heights.

Figure 4:
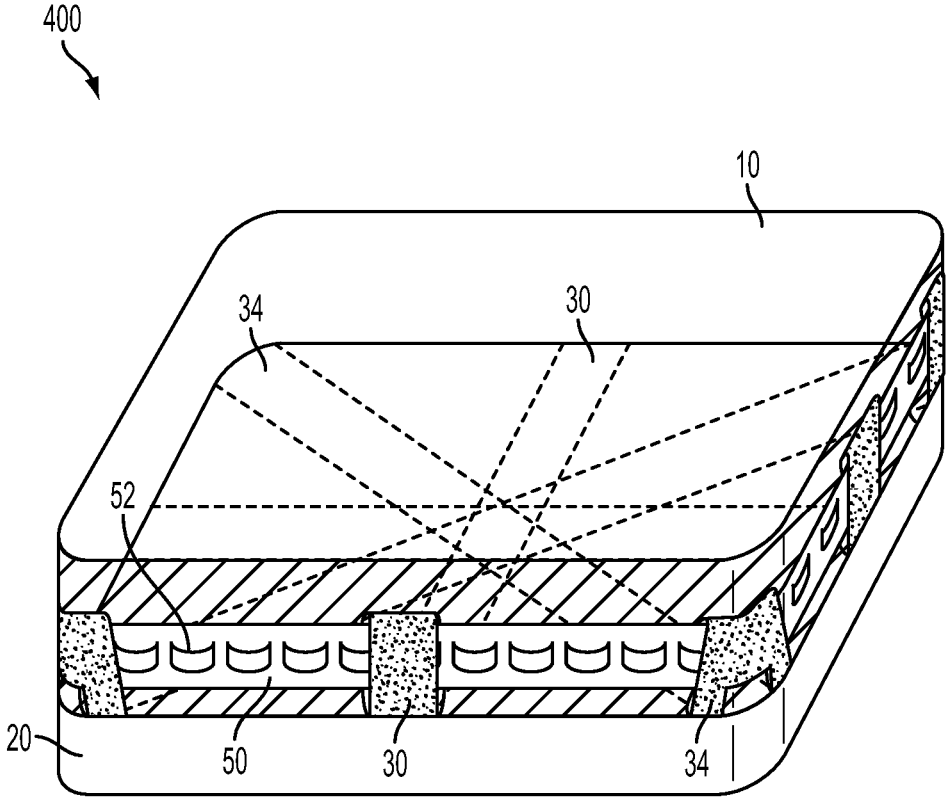
FIG. 4 illustrates another exemplary bed assembly.

FIG. 4 illustrates another exemplary bed assembly 400, including a mattress 10, a support frame 20, a horizontal band 50 with exercise loops 52, reinforcement straps 30, and reinforcement corner straps 34. The bed assembly 400 is similar to the bed assembly 100 of FIGS. 1A and 1B. The reinforcement straps 30, 34 create a diamond pattern under the mattress 10 (shown in FIG. 4 with dotted lines). Reinforcement corner strap 34 is split around the corner of the mattress 10, but reforms as a single strap under the mattress 10, extending diagonally under the mattress 10 to the opposite corner. The diamond pattern secures the horizontal band 50 while using fewer reinforcement straps for support.

Figure 5:
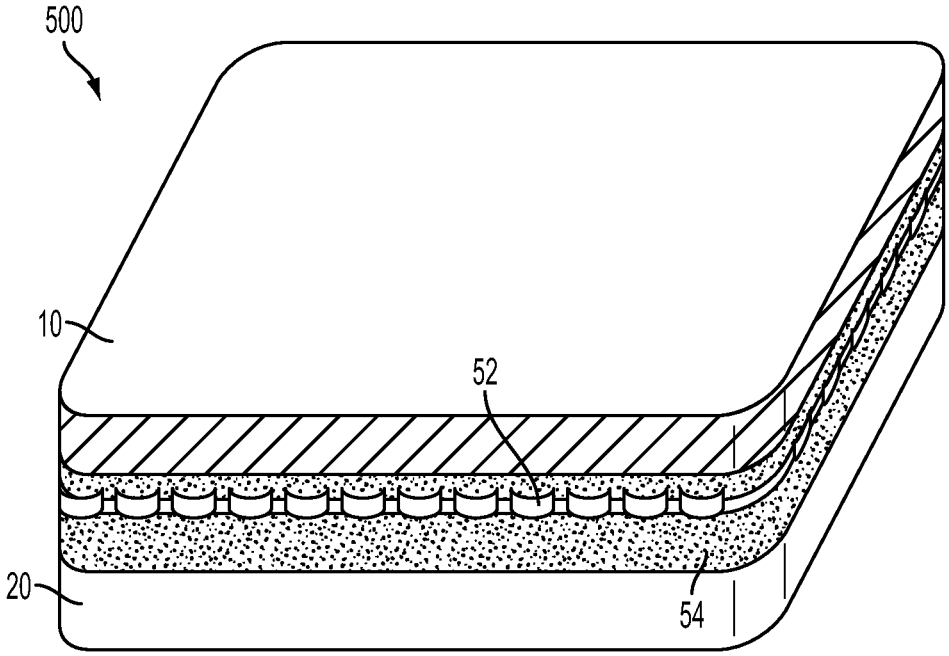
FIG. 5 illustrates another exemplary bed assembly.

FIG. 5 illustrates another exemplary bed assembly 500, including a mattress 10, a support frame 20, and an exercise frame 54 with exercise loops 52. In the illustrative embodiment, the exercise frame 54 includes the horizontal band and a reinforcement sheet connected to the horizontal band. The reinforcement sheet can be attached at a first side of the horizontal band, extend below the mattress 10, and be attached at a second side on the horizontal band at the opposite side of the mattress 10. In some embodiments, the exercise frame 54 can be sized to the dimensions of a standard mattress and may be made of a material like elastic to be placed around the mattress 10. In other embodiments, a portion of the exercise frame 54 (e.g., a corner) can include tightening means (not shown) to tighten the sides of the exercise frame 54 once placed around the mattress 10. In the embodiment of FIG. 5, as well as all other embodiments described herein, and further embodiments that one of skill in the art may contemplate based on the embodiments disclosed herein, the bed assembly can include the exercise frame 54 with or without a reinforcement sheet, and the exercise frame 54 may be wrapped around the mattress 10, the support frame 20, or both the mattress 10 and support frame 20.

Figure 6:
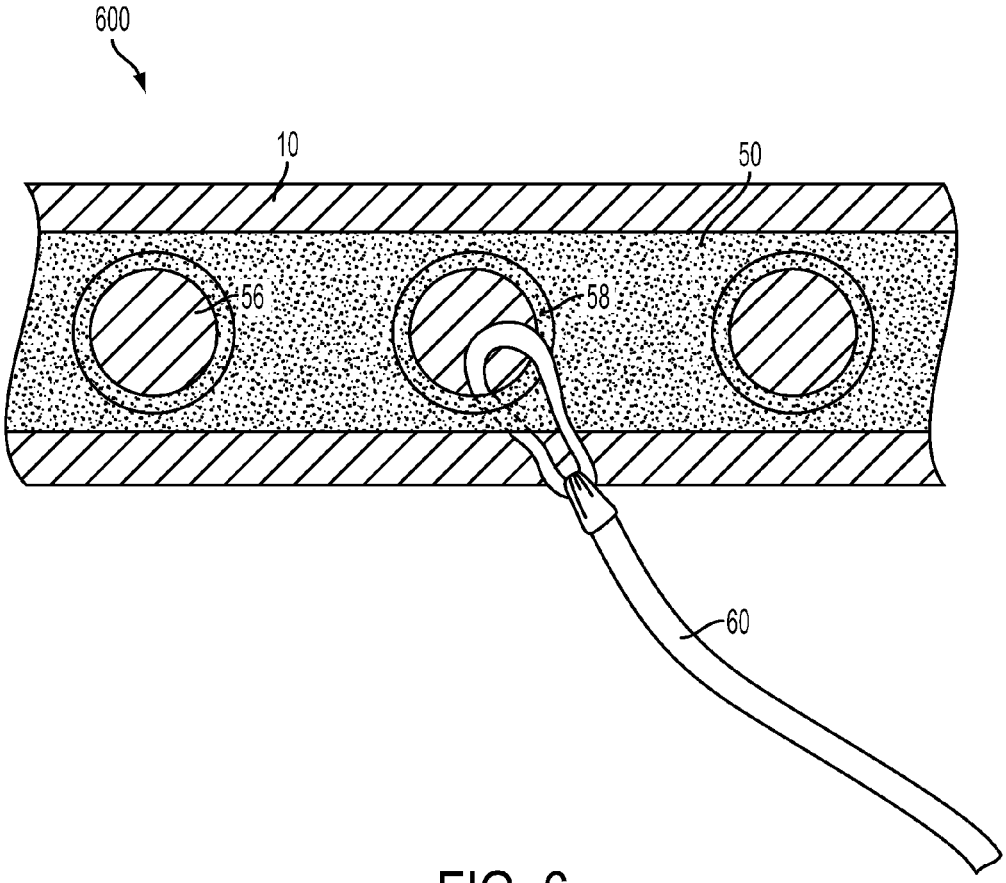
FIG. 6 illustrates a side view of another exemplary bed assembly.

FIG. 6 illustrates a side view of another exemplary bed assembly 600 including horizontal band 50 and holes 56 with reinforcement grommets 58. In the bed assembly 600, the mattress 10 has the horizontal band 50 including holes 56 fitted around its circumference. In the illustrative embodiment, holes 56 each include a reinforcement grommet 58. This reinforcement grommet 58 can maintain support for the hole 56 when either a reinforcement strap 30 (not shown) or exercise band 60 is connected to it. The grommet 58 can be made of supportive material, such as metal, rubber, or plastic. The holes 56 can provide connection points on the horizontal band 50, while the grommets 58 can be added to the holes 56 to prevent tearing or abrasion of the horizontal band 50 in locations near the holes 56.

Figure 7A:
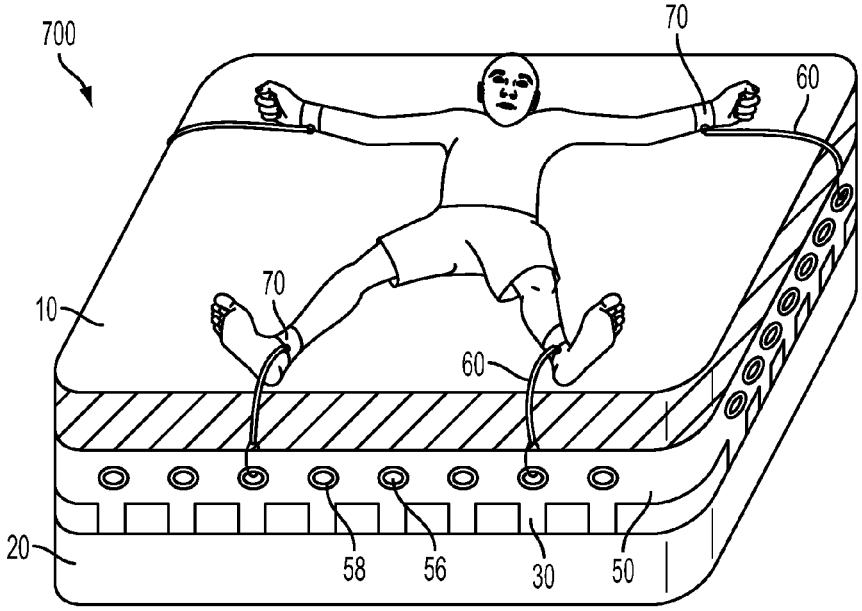
FIG. 7A illustrates another exemplary bed assembly.

FIG. 7A illustrates another exemplary bed assembly, including a mattress 10, a support frame 20, a horizontal band 50 with reinforcement straps 30, holes 56, and support grommets 58. The bed assembly also includes single-ended restraint bands 60 with cuffs 70 attached to the user on the mattress 10. In some embodiments, the holes 56 on the horizontal band 50 can be replaced with other points of connection, such as exercise loops 52 illustrated in FIG. 1. In comparison with the bed assembly 200, the bed assembly 700 has been modified with restraint bands 60 that at least partially immobilize a user. In some embodiments, the user may have one or more parts of the body restrained using one or more restraint bands 60 connected to the cuffs 70 fitting the applicable body part. In the illustrative embodiment, for example, the user is restrained at four limbs using four restraint bands 60 with four fitting cuffs 70 to the point that he is effectively immobilized. In other embodiments, the material of restraint bands 60 and/or the length of the restraint bands 60 can be chosen and/or modified to allow the user to have a wider range of motion while restrained by the cuffs 70. In some embodiments, other attachments (not shown) can be attached to the horizontal band 50, for example, through attachment through holes 56 for engagement with the user. For example, other devices can be anchored to the horizontal band 50 to be connected, further constrain, or to further engage the user while the user is restrained.

Figure 7B:
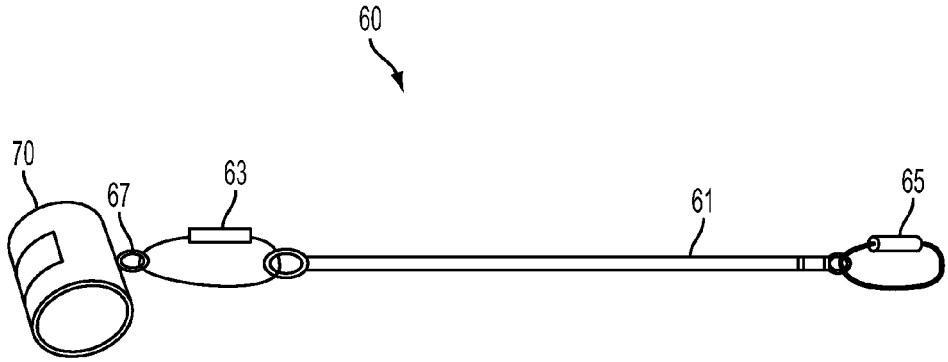
FIG. 7B illustrates an exemplary single-ended restraint band.

FIG. 7B illustrates an exemplary single-ended restraint band 60 that includes flexible band 61, connectors 63, 65, handle attachment 67, and cuff 70. Single-ended restraint band 60 is similar to the single ended exercise band 60 of FIG. 2B, though the restraint band 60 is configured with the primary purpose of at least partially immobilizing the user instead of enabling the user to engage in resistance exercises. For example, the flexible band 61 can be made from a wider range of materials than the stretching band 61, as the flexible band can be made from flexible, non-stretching materials (e.g., leather) and similar materials known to a person of skill in the art. Similarly, the handle 69 of the exercise band 60 in FIG. 2B has been replaced with cuff 70, which fits around the body part of the user. Cuff 70 can be made of material such as cloth, leather, metal, nylon, elastic, or similar material to fit around a body part of the user. Other types of user restraints to be connected to the restraint band 60 will be known to a person of skill in the art. Depending on the preference of the user, the type of cuff 70 can be chosen for the comfort of the user. For example, in some embodiments, the cuffs 70 can be made of a soft material with easier closing mechanisms, such as a buckle closure. In other embodiments, the cuffs can be made of more rigid material, such as metal cuffs, and include locks as closing mechanisms (i.e., a key lock). In some embodiments, one user can place a body part within the cuff 70 and engage the closing mechanism. In some embodiments, a second user may be required to place a user's body part within the cuff and engage the closing mechanism.

While the technology has been particularly shown and described with reference to specific illustrative embodiments, it should be understood that various changes in form and detail may be made without departing from the spirit and the scope of the technology.

We claim:

1. An exercise bed assembly comprising:

a) a bed comprising a mattress, a support frame, or both a mattress and a support frame, having a resting surface and four vertical sides;

b) an exercise assembly fitted around the four vertical sides of at least one of the mattress or the support frame, the exercise assembly comprising a horizontal band having a length at least equal to the circumference of the four vertical sides of at least one of the mattress or the support frame;

c) a plurality of features on the band spaced about the length of the horizontal band, each of the plurality of features on the band being configured to removable receive an exercise device;

d) a plurality of separate elastic devices, each of the plurality of elastic exercise devices comprising, at a first end, an attachment member configured to removably attach the elastic exercise device to one or more of the plurality of features on the band, and comprising, at a second end, a user interface member; and e) a reinforcement piece connected to the horizontal band, wherein in use the reinforcement piece extends under the mattress or the support frame from a first connection point on the horizontal band to a second connection point opposite the first connection point.

2. The exercise bed assembly of claim 1, wherein the user interface member comprises a handle, strap, loop, or cuff.

3. The exercise bed assembly of claim 1, wherein the reinforcement piece comprises at least one reinforcement strap.

4. The exercise bed assembly of claim 3, wherein the at least one reinforcement strap further comprises a plurality of adjustment loops, wherein the horizontal band extends through one of the plurality of adjustment loops to permit a vertical adjustment of the horizontal strap relative to the mattress, support frame, or both the mattress and support frame.

5. The exercise bed assembly of claim 1, wherein the reinforcement piece comprises:

a reinforcement sheet affixed to the horizontal band.

6. The exercise bed assembly of any of claims 1, wherein the horizontal band further comprises fastening means at each end of the horizontal band.

7. The exercise bed assembly of claim 6, wherein the fastening means comprises a catch and a buckle.

8. The exercise bed assembly of claim 1, wherein at least one of plurality of features on the band configured to receive an exercise device comprises at least one reinforced hole within the horizontal band.

9. The exercise bed assembly of claim 1, wherein the horizontal band has a length in use at least equal to the circumference of the mattress and/or support frame, respectively.

10. An exercise assembly comprising:

a) a horizontal band configured to be fitted around four vertical sides of at least one of a bed mattress or a bed support frame having a resting surface and four vertical sides, and having a length at least equal to a circumference of the four vertical sides of the at least one of the bed mattress or the bed support frame;

b) a plurality of features on the band spaced about the length of the horizontal band, each of the plurality of features on the band being configured to removably receive an exercise device;

c) a plurality of separate elastic exercise devices, each of the plurality of separate elastic exercise devices comprising, at a first end, an attachment member configured to removably attach the elastic exercise device to one or more of the plurality of features on the band, and comprising, at a second end, a user interface member; and d) a reinforcement piece connected to the horizontal band, wherein the reinforcement piece is configured to extend under the bed mattress or the bed support frame from a first connection point on the horizontal band to a second connection point opposite the first connection point.

11. The exercise assembly of claim 10, wherein the reinforcement piece comprises at least one reinforcement strap.

12. The exercise assembly of claim 10, wherein at least one of the plurality of features on the horizontal band comprises at least one hole within the horizontal band sized to removably receive and retain an attachment member of the plurality of separate.

13. The exercise assembly of claim 12, wherein the at least one hole comprises a grommet.

14. The exercise assembly of claim 10, wherein the horizontal band has a length greater than the circumference of the lateral sides of the bed mattress or the bed support frame.

15. The exercise assembly of claim 10, wherein the user interface member comprises a handle, strap, loop, or cuff.

16. The exercise assembly of claim 10, wherein the attachment member of each of the plurality of elastic exercise devices is configured to be selectively and removably attached to any of the plurality of features on the band.

* * * * *

UNITED STATES PATENT AND TRADEMARK OFFICE

CERTIFICATE OF CORRECTION

PATENT NO. : 9,282,829 B2
APPLICATION NO. : 13/627649
DATED : March 15, 2016
INVENTOR(S) : Grace Caruso et al.

It is certified that error appears in the above-identified patent and that said Letters Patent is hereby corrected as shown below:

Claims

On Column 7, Line 42 (Claim 1, Line 13), delete the word "removable" and insert --removably-- therefor;

On Column 8, Line 49 (Claim 12, Line 5), insert --elastic exercise devices-- after the word "separate".

Signed and Sealed this
Seventeenth Day of May, 2016

Michelle K. Lee

Michelle K. Lee
*Director of the United States Patent and Trademark Office*